United States Patent [19]

Reuland

[11] 4,280,516

[45] Jul. 28, 1981

[54] METHOD AND APPARATUS FOR PRODUCING A CONTINUOUS FILLER OF TOBACCO OR THE LIKE

[75] Inventor: Joachim Reuland, Neu Börnsen, Fed. Rep. of Germany

[73] Assignee: Hauni-Werke Körber & Co. KG, Hamburg, Fed. Rep. of Germany

[21] Appl. No.: 61,352

[22] Filed: Jul. 27, 1979 (Under 37 CFR 1.47)

[30] Foreign Application Priority Data

Jul. 28, 1978 [DE] Fed. Rep. of Germany ..... 2833118

[51] Int. Cl.[3] ..... A24C 5/14; A24C 5/39

[52] U.S. Cl. ..... 131/84 C; 131/21 C; 131/21 D; 131/84 A; 131/906

[58] Field of Search ..... 131/84 R, 84 C, 21 B, 131/21 C, 21 D, 21 R, 84 A

[56] References Cited

U.S. PATENT DOCUMENTS

| | | | |
|---|---|---|---|
| 3,750,675 | 8/1973 | Kleme | 131/21 B |
| 4,036,238 | 7/1977 | Okumoto | 131/21 B |
| 4,037,608 | 7/1977 | Wahle | 131/21 B |
| 4,190,061 | 2/1980 | Heitmann et al. | 131/21 B |

*Primary Examiner*—Stephen C. Pellegrino
*Attorney, Agent, or Firm*—Peter K. Kontler

[57] ABSTRACT

The production of an elongated filler which is to be densified, wrapped and severed to yield discrete cigarettes is controlled in dependence on the mass flow of the filler after densification and is influenced by a parameter, such as the height, density, flow resistance or capacitance of the filler prior to densification. The control involves selection of the distance between an equalizer which removes the surplus of fibers from a tobacco stream on a conveyor which advances the stream and the filler. The parameter may be monitored at, downstream of or upstream of the equalizer but always upstream of the densifying station. The control signal for the desired position of the equalizer with reference to the conveyor is a function of one or more of the parameters.

42 Claims, 11 Drawing Figures

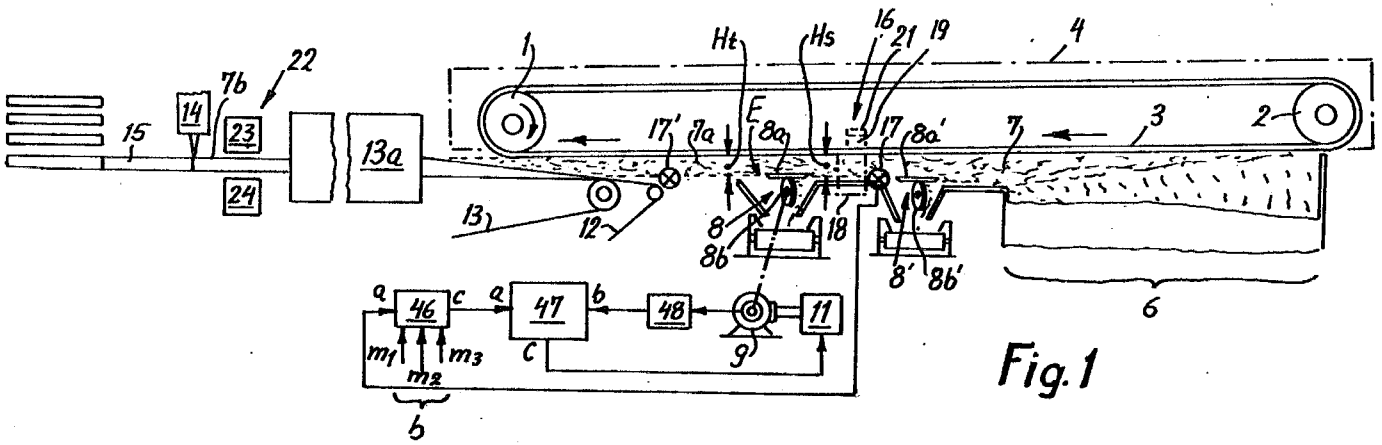
Fig. 1
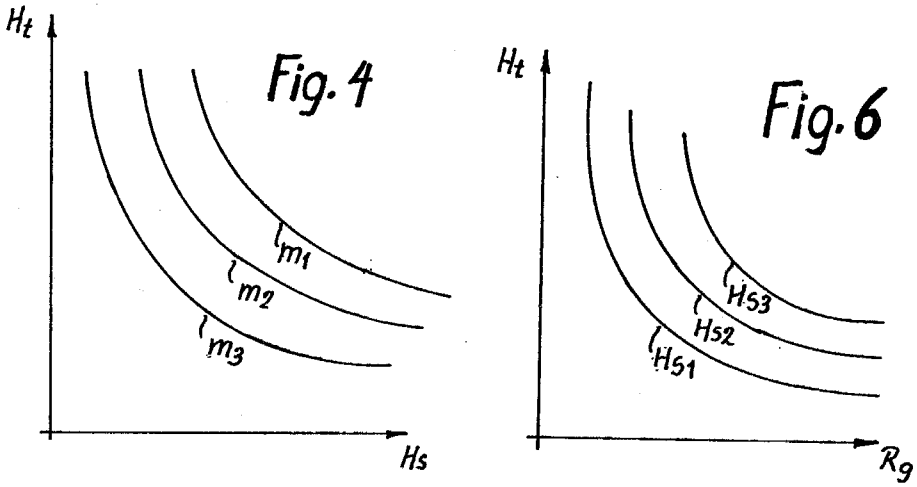
Fig. 4
Fig. 6
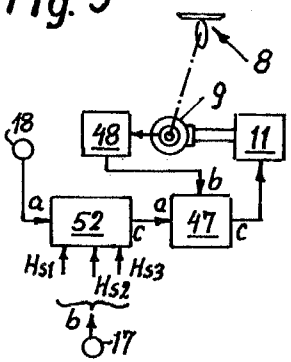
Fig. 5

Fig. 2
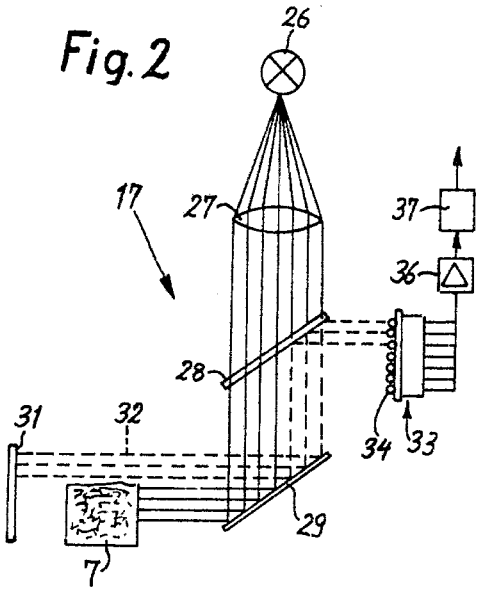
Fig. 3
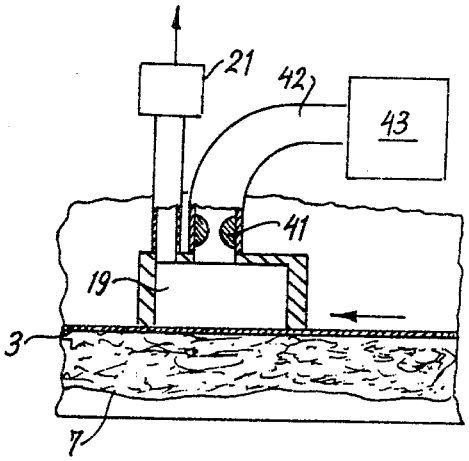
Fig. 7
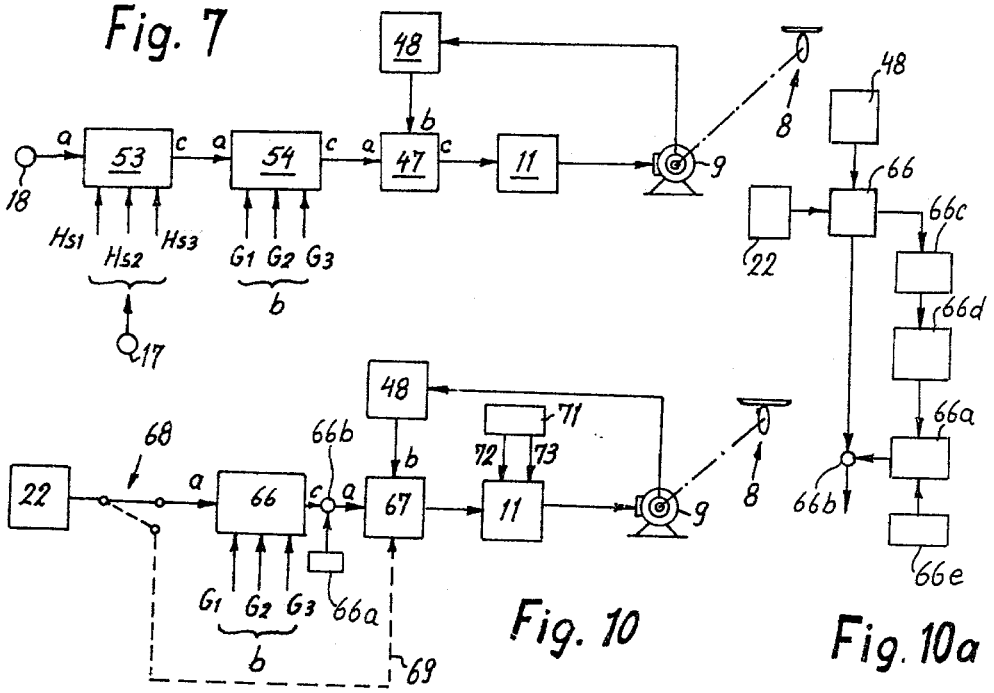
Fig. 10
Fig. 10a

METHOD AND APPARATUS FOR PRODUCING A CONTINUOUS FILLER OF TOBACCO OR THE LIKE

BACKGROUND OF THE INVENTION

The invention relates to a method and an apparatus for producing an elongated rod-like filler which consists of fibers, especially tabacco shreds. More particularly the present invention relates to a machine and method of making cigarettes or the like.

It is already known, particularly in the cigarette industry, to form a continuous stream, to advance the stream, to equalize the advancing stream by removing the surplus of fibers therefrom, and to densify and confine the equalized stream to form a wrapped filler (such as a cigarette rod which is severed to yield discrete cigarettes). It is further known to control the removal of surplus fibers in dependence on a signal wich is indicative of the mass flow of the equalized stream, preferably subsequent to wrapping of the stream.

Conventional apparatus for the practice of such method employ a conveyor on which the stream is formed and by means of which the stream is advanced, an equalizer which removes the surplus of fibers from the advancing stream at a trimming station, a device ffor densifying the equalized stream downstream of the equalizer and for confining the densified stream in a web, a device for monitoring the mass flow of the equalized stream, preferably downstream of the wrapping station, and a control arrangement which regulates the distance between the equalizer and the conveyor in response to signals from the monitoring device.

The term "densification", is intended to denote conversion of the equalized, but unwrapped, stream into a filler having the shape or cross section of the wrapped tobacco filler (or cigarette rod), from which discrete cigarettes are severed at regular intervals. Such conversion is performed by a so-called garniture in which the equalized stream is compressed during passage therethrough and which, consequently, acts as a densifying arrangement. However, in the event that the tobacco in the tobacco filler is already considerably compressed during advancement to the equalizing station and/or the garniture (for instance, by subjecting the tobacco stream on the air-permeable conveyor to the action of a pronounced subatmospheric pressure), it can happen than the cross section of the equalized tobacco stream is the same or even smaller than the cross section of the filler in the cigarette rod. Under such circumstances the expression "densification" is intended to denote conversion of the tobacco stream into a filler having the cross section of the wrapped cigarette rod. It is customary in the manufacture of cigarettes to control the formation of the tobacco filler which is subsequently densified, wrapped and subdivided into discrete cigarettes in such a manner that a constant quantity of tobacco (per unit length) is available in the wrapped cigarette rod and thus in each of the discrete cigarettes. For this purpose, one employs a monitoring device (e.g., a beta ray detector), which generates signals denoting the density of tobacco in the cigarette rod, and such signals are used to regulate the distance between the conveyor and the cutting plane of the equalizing or trimming devices which removes larger or smaller quantities of surplus tobacco from the filler. However, as a rule, the smoker cannot examine a cigarette as to its tobacco content. Consequently, the smoker evaluates a cigarette according to its hardness or rigidity, which depends on the filling force of tobacco. The hardness is determined by the resistance which the tobacco shreds in a cigarette offer to a force of such magnitude as to cause elastic deformation of the cigarette. The smoker can examine such hardness by pressing his or her fingers against the cigarette. In view of this, it can be advantageous to control the formation of a tobacco filler in a cigarette maker not for the purpose of maintaining the quantity of tobacco at a constant value, but rather to achieve constant hardness.

It is known to provide special devices for direct monitoring of the hardness of a wrapped cigarette rod. U.S. Pat. No. 3,411,513 discloses a nozzle which directs air against a cigarette rod, and means for ascertaining the extent of elastic deformation of the cigarette rod, the extent of such deformation denoting the hardness of the rod. Another monitoring device is disclosed in British Pat. No. 1,468,169 in which a contact roller is pressed against the surface of the tobacco rod with a predetermined force. Conclusions may be drawn from the elastic deformation and the corresponding change in position of the contact roller as to the hardness, and an equalizer can be controlled accordingly.

It has been established that the devices for direct monitoring of hardness and corresponding adjustments of the equalizer do not always perform to satisfaction.

OBJECTS AND SUMMARY OF THE INVENTION

It is an object of the invention to provide a method of controlling the production of a cigarette rod or a similar elongated article, which renders it possible to achieve constant hardness of the final product.

Another object of the present invention is to provide a method which renders it possible to take into consideration several variable parameters of the rod which is used for the manufacture of the final product.

A concomitant object of the invention is to provide an apparatus for the practice of the above-mentioned method.

An additional object of the present invention is to so construct the apparatus as to be relatively simple inexpensive and, easy to operate.

One feature of the present invention resides in the provision of a method of producing an elongated filler consising of fibers, especially tobacco shreds, which comprises the steps of continuously forming from the fibers an elongated stream which contains a surplus of fibers and advancing the stream lengthwise; equalizing the advancing stream by removing the surplus of fibers therefrom, generating a first signal which denotes the height of the equalized stream, densifying and wrapping the equalized stream to convert the stream into the filler; generating a second signal in dependence on the mass flow of the equalized strand; correcting the mass flow signal in accordance with a function which is indicative of a desired hardness of the filler and represents a predetermined relationship between the first and second signals generating a control signal in dependence on the corrected second signal, and regulating the equalizing step in dependence on the control signal so as to maintain the hardness of the filler at a constant value.

Monitoring of the height of the equalized stream can be carried out in a contactless manner, e.g., optoelectronically. However, other contactless monitoring steps can be resorted to, for instance, capacitive monitoring or monitoring with ultrasonic waves with an air stream or the like.

A particularly advantageous steps of ascertaining the actual value of the height of the equalized stream involves monitoring the distance between the trimming plane and the conveyor for the stream inasmuch as the position of the trimming plane determines the height of the equalized nondensified stream.

In order to facilitate rapid influencing of the height of the stream, a further signal corresponding to the height of the non-equalized stream can be formed upstream of the trimming station, and such further signal is used to influence the removal of surplus fibers. What is meant by this is that the further signal is indicative of a parameter which is anticipated at the trimming station when the measured increment of the stream reaches a corresponding value, and that the distance between the trimming plane and the conveyor is changed in anticipation of the arrival of such increment at the trimming station. The further signal can be formed in a contactless manner, preferably optoelectronically. With this further signal, it is possible to form the control signal for regulation of the removal of surplus of fibers in dependence on the further signal which is corrected in accordance with a function that is predetermined for a desired value of hardness of the wrapped densiffied filler (cigarette rod) and represents a predetermined relationship between the signal denoting the height of the equalized nondensified stream and the signal denoting the height of the unequalized stream. The control signal then serves fo regulation of the distance between the trimming plane and the conveyor for the stream in the sense of maintaining the hardness of the wrapped filler at a constant value.

Another mode of rapidly influencing the removal of surplus fibers so as to eliminate the influence of an undesirable parameter resides in that an additional signal dependent on the flow resistance of the fibers between exposed surface of the non-equalized stream and the conveyor is formed upstream of the trimming station. This additional signal can be formed by drawing an air stream by drawing transversely of the direction of advancement of the tobacco stream, and monitoring the influence of fibers upon such air stream. Herein, the control signal for regulating the removal of the surplus of fibers can be formed in dependence on the additional signal which is corrected in accordance with a function that is predetermined for a desired value of the hardness of the wrapped and densified filler (cigarette rod) and represents a predetermined relationship between the height of the equalized non-densified stream and the additional signal which is dependent on the flow resistance; the control signal again serves to regulate the distance of the trimming plane and the conveyor for the purpose of maintaining the hardness of the wrapped and densified filler, and thus of the cigarettes, at a constant.

A combination of the above-mentioned modes of rapidly influencing the formation of the filler for the purpose of maintaining the hardness in the cigarette rod or the hardness of the cigarettes at a constant value can be achieved by generating a signal corresponding to the density of the non-equalized stream in accordance with a function which represents a predetermined relationship between the density and height of the stream as well as the flow resistance. The signal denoting the anticipated regulation of removal of the surplus of fibers is formed in dependence on a function that is selected in advance for a desired hardness of the filler and represents a predetermined relationship between the height of the equalized non-densified stream and the signal which denotes the density.

In accordance with a modification of the method, the control signal denoting the anticipated regulation of removal of the surplus of fibers can be formed in dependence on a signal denoting the density to tobacco (density measuring signal) in the stream. The tobacco forms the dielectric of a capacitor in a high-frequency oscillating circuit the capacitance and damping of which are monitored independently of each other. The density of tobacco is determined as a function of capacitance and damping of the high-frequency oscillating circuit. The control signal is formed in dependence on the density signal which is corrected in accordance with a function that is selected as a function of a desired rigidity of the filler and represents a predetermined relationship between the signal denoting the height of the equalized non-densified stream and the density signal. Herein, constant determination values related to the capacitance and damping of the oscillating circuit can be stored; after ascertaining the values of the capacitance and damping, the determination of the density of the tobacco can occur automatically by way of the stored signals. The signals can be stored as coefficients and functions in the form of polynomials of the n-th order.

The control signals which are generated by the abovementioned monitoring devices can constitute desired value or reference signals which are transmitted to position-regulating circuits for the trimming plane, while the actual value signals may be formed in dependence on the height of the equalized non-densified stream.

The apparatus which is especially suited for the practice of the method of the present invention comprises a function generator which connected to a mass flow measuring means. The signal at the output of the function generator is formed in correspondence with a function which represents, for a desired hardness of the densified and wrapped, a predetermined relationship between the height of the equalized non-densified stream and the signal denoting the mass flow of the equalized stream, and such output signal is transmitted to the means for controlling the distance between the equalizing means and the conveyor to serve as a control signal which determines the height of the equalized non-densified stream.

According to a further embodiment of the apparatus, there is provided a position-regulating circuit which determines the location of the trimming plane of the equalizer and constitutes the function generator. The actual value generator of this position-regulating circuit is a device for contactless monitoring of the height of the equalized non-densified stream, preferably an optoelectronic monitoring device. However, the actual value generator can also constitute a device which senses the position of the equalizer relative to the conveyor, inasmuch as the locus of the removal plane (cutting plane) of the equalizer denotes the height of the equalized nondensified stream.

The above-mentioned filler formation with its regulation of the cigarette rod or of the cigarettes severed from the latter to ensure constant hardness can be influenced, in accordance with a further embodiment of the invention, by so-called "advance controls" in which the control signals for the equalizer are already formed before the tobacco stream reaches the equalizer. In this manner, deviations from the desired hardness can be compensated for, at least partially, before the feedback control (i.e., the control based on the hardness of the densified stream) with its unavoidable delays intervenes. This feedback control then serves in the combination of the advance control and feedback control basically for long-term control.

For an advance control, especially when the non-equalized tobacco stream has a constant mass flow, there can be provided upstream of the removal location a monitoring device which senses the height of the non-equalized stream and which is preferably an optoelectronic system, the output signal of which is transmittable to the control arrangement. A function generator is connected to this monitoring device and its output signal is a function representing, for the desired hardness value of the densified wrapped stream, a predetermined relationship between the height of the equalized non-densified stream and the signal which denotes the height of the non-equalized stream. Such signal transmitted to the control arrangement as a control signal for the height of the equalized non-densified stream.

Another type of the advance control, which is especially suited when the non-equalized tobacco stream has a constant height, is provided with a monitoring device which is located upstream of the trimming station and senses the flow resistance of the fibers of the tobacco stream between the exposed surface of the latter and the conveyor. Such monitoring device preferably comprises a suction chamber and its output signal is transmittable to the control arrangement. A function generator is provided downstream of this device and its output signal is formed in correspondence with a function which represents, for the desired hardness of the densified wrapped stream, a predetermined relationship between the height of the equalized non-densified stream and the signal denoting the flow resistance of the non-equalized stream. Such signal is transmitted to the control arrangement as a control signal for the height of the equalized non-densified stream.

If the non-equalized tobacco stream fluctuates both as to mass flow and to height, a function generator is connected to the means which monitor the strand height and the flow resistance of the stream which are installed upstream of the trimming station. The output signal of such function generator is formed in correspondence with a function representing, for the desired hardness of the densified wrapped filler, a predetermined relationship between the density of the equalized non-densified stream and the signals denoting the height of the stream as well as the flow resistance of the non-equalized stream. The output signal is transmitted to a further function generator the output signal of which is a function representing, for the desired hardness of the densified wrapped stream, a predetermined relationship between the height of the equalized non-densified stream and the values which correspond to the density of the non-equalized stream. This output signal is transmitted to the control arrangement as a control signal for the height of the equalized non-densified stream.

Another mode of sensing the density of the tobacco stream is that of using a monitoring device for the density of tobacco upstream of the trimming station. The device includes a measuring capacitor which is passed by the tobacco as a dielectric and is incorporated in a high-frequency oscillating circuit connected with an arrangement for measuring the capacitance of the measuring capacitor and with an arrangement for damping the high-frequency oscillating circuit. The outputs of the circuit are connected with an evaluating arrangement for determination of the mass of tobacco which represents a function of the capacitance measuring capacitor and of the damping of the oscillating circuit, based on constant stored determination values which are associated with the function values for the capacitance and damping. The arrangement for measuring the capacitance may be constructed as a resonance frequency measuring arrangement for an electrical value of the high-frequency oscillating circuit, preferably for the high-frequency voltage.

The signals of the advance control can be transmitted as control values (desired values) to a circuit which determines the locus of the trimming plane of the equalizer. The actual value generator of such advance control is a measuring arrangement which senses the height of the equalized non-densified stream. A contactless measuring arrangement, preferably an optoelectronic measuring arrangement, can be used as the actual valve generator. However, the actual value can also be sensed, in a manner which is especially simple, by an arrangement which monitors the position of the equalizer relative to the conveyor.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 1 is a somewhat diagrammatic view of a tobacco stream forming station in a cigarette making machine and of a control arrangement for influencing the formation of the stream for the purpose of achieving a constant hardness of cigarettes in dependence on a measurement of the height of the stream;

FIG. 2 shows an optoelectronic arrangement for monitoring the height of the non-equalized stream;

FIG. 3 shows a pneumatic arrangement for monitoring the flow resistance of the non-equalized stream transversely of the direction of its advancement;

FIG. 4 is a diagram of the functional relationship between the height of the non-equalized stream and the height of the equalized non-densified stream;

FIG. 5 shows a control arrangement for influencing the formation of the stream for the purpose of achieving a constant hardness of cigarettes in dependence on the flow resistance of the tobacco stream transversely of the direction of advancement;

FIG. 6 is a diagram of the functional relationship between the flow resistance of the non-equalized stream and the height of the equalized non-densified stream;

FIG. 7 shows a control arrangement for influencing the formation of the stream for the purpose of achieving constant hardness of the cigarettes in dependence on the height and the flow resistance of the nonequalized stream;

FIG. 10 shows a regulating arrangement for influencing the formation of the stream for the purpose of achieving constant hardness of cigarettes in dependence on the density of the equalized densified, and wrapped cigarette rod; and FIG. 10*a* shows a modification of the regulating arrangement of FIG. 10.

DESCRIPTION OF THE PREFERRED EMBODIMENTS

Figure 8:
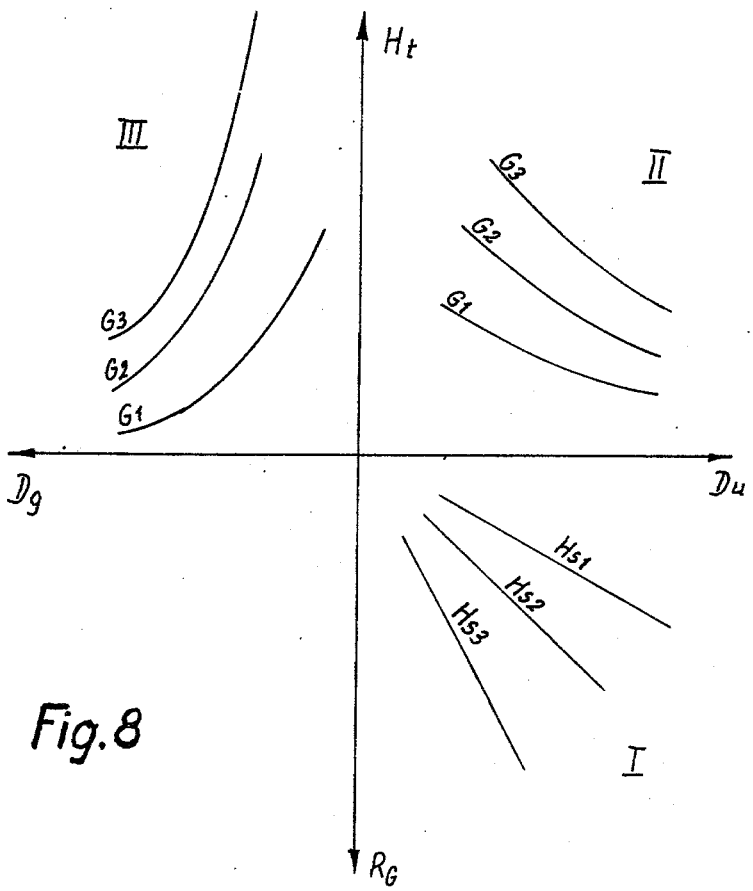
FIG. 8 is a diagram of functional relationship between the density of the stream established by signals denoting the height of the stream and the flow resistance, and the functional relationship between the strand density of the stream and the height of the equalized non-densified stream in dependence on different cigarette hardness.

Referring to FIG. 1, the reference numeral 3 denotes an air-permeable conveyor belt which is mounted in a suction chamber 4. The conveyor belt 3 is trained about rollers 1 and 2, and is first guided over a stream building zone 6 in which fibers (e.g., shreds of tobacco) ascend (in that they are either mechanically flung up, e.g., by means of a brush, or transported up by means of an air stream), and become and remain suspended, due to suction in the chamber 4, at the underside of the lower reach of the conveyor belt 3 in the form of a non-equalized stream 7. The conveyor belt 3 advances the tobacco stream past a known equalizer 8 which removes excess tobacco from the downwardly facing exposed surface of the tobacco stream 7. The equalizer 8 can comprise a rotating circular knife which cooperates with a serrated wheel. However, it can also be provided with clamping discs 8*a*, wherein the excess tobacco is removed by means of a brush 8*b* (or a paddle wheel). Details of an equalizing arrangement of the last-mentioned type are disclosed, for instance, in U.S. Pat. No. 3,030,966.

The distance between the cutting plane E of the equalizer 8 and the conveyor belt 3 is adjustable by means of a controllable drive 9 (positioning motor), which is controlled by a control arrangement 11.

An equalized non-densified tobacco filler 7*a* is transferred onto a web 12 of wrapping material (in general, a paper strip), and is advanced by a band 13 through a format garniture 13*a* in which the tobacco filler 7*a* is densified and in which the web 12 is draped around the tobacco filler and glued to form a cigarette rod 7*b*.

In the event that the tobacco filler 7*a* is densified to, or even below, the cross section of the cigarette rod 7*b*, which can be obtained, for instance, as a result of compression due to pronounced suction in the chamber 4, the format garniture 13*a* merely transforms the tobacco filler 7*a* so as to exhibit the generally round cross section of the cigarette rod 7*b*. Even this possibility is to be understood as being embraced by the expression "densification".

Downstream of the format garniture 13*a*, cigarettes 15 are severed from the cigarette rod 7*b* by a cutoff 14 and are removed for further processing. A measuring arrangement 16 is disposed upstream of the equalizer 8. It can include an optoelectronic device 17 for monitoring the height of the non-equalized tobacco stream 7 (and thus the distance between the exposed surface of the stream and the conveyor belt 3). Details of this optoelectronic device are described in connection with FIG. 2. Alternatively, the measuring arrangement 16 can comprise a pneumatic monitoring device 18 for measuring the flow resistance of the tobacco fibers transversely to the direction of advancement of the tobacco stream, that is, in direction toward the conveyor belt 3. FIG. 3 shows the details of the monitoring device 18. However, the measuring arrangement 16 can also include both monitoring devices 17 and 18.

The monitoring device 18 of FIG. 3 includes a suction chamber 19 at that side of the conveyor belt 3 which faces away from the tobacco stream 7. The air stream which flows through the tobacco stream 7 and the conveyor belt 3 and thus the pressure in the chamber 19 is dependent on the flow resistance of the tobacco fibers of the non-equalized tobacco stream 7. An electric signal corresponding to the suction can be formed by means of a pressure sensitive semiconductor or a diaphragm transducer 21 which is known for measuring pneumatic values.

A known measuring arrangement 22 is installed downstream of the equalizer 8 and transmits a signal which denotes the density of tobacco forming the filler of the tobacco rod which has been densified to a constant cross section, namely, in the wrapped cigarette rod 7*b*. Advantageously, the measuring arrangement 22 is a known beta-ray detector with an emitter 23 capable of emitting beta-rays and including a radioactive preparation, and with a receiver 26, for example, an ionization chamber.

FIG. 2 shows the details of the optoelectronic monitoring device 13 for measuring the height of the non-equalized tobacco stream 7. A light source 26 transmits, via a lens 27, parallel light rays through a partially light-transmitting mirror 28 and, via a reflecting mirror 29, onto a reflecting mirror 31. The tobacco stream 7 is advanced at right angles to the plane of the drawing across the path of light between the reflecting mirrors 31 and 29. In the illustrated embodiment, the tobacco stream 7 covers the light only in part, so that some of the light rays, namely, the rays 32 which bypass the tobacco stream 7 and are shown by broken lines, reach the mirror 31 while the remaining rays which are shown by full lines are intercepted by the tobacco stream 7. The reflected light rays 32 return to the partially light-transmitting mirror 28, which directs them to a photosensitive transducer 33. The latter includes a row of seven light-electric elements (e.g., phototransistors) 34 which are disposed one above the other. The non-covered upper part of the tobacco stream 7 is indicated by three phototransistors 34 which receive the reflected light rays 32. The three signals for the height of the tobacco strand 7 upstream of the equalizer 8, which are recieved in this manner by the transducer 33, are amplified by an amplifier 36 and summed by means of a totalizing circuit 37. The output signal of the totalizing circuit 37 thus denotes the height of the tobacco stream 7.

Instead of an analog output signal, the optoelectronic monitoring device 17 can also transmit a digital output signal in that the individual light-electric elements 34 correspond to certain digits of a number which is constituted for instance, in a binary manner.

FIG. 3 further shows additional details of the pneumatic monitoring device 18 in which a signal corresponding to the flow resistance of the non-equalized tobacco stream 7 transversely to the direction of its advancement is formed. The suction chamber 19 is further connected with a suction generating device 43 by way of a flow restrictor 41 in a conduit 42. Further connected to the suction chamber 19 is the aforementioned diaphragm transducer 21 which is known from the art of measuring pneumatic signals and converts such signals into electrical measuring signals. The suction is dependent on the flow resistance which the tobacco stream offers to the flow of the measuring air stream from the exposed surface of the tobacco stream 7 through the latter and the air-permeable conveyor belt 3 and into the suction chamber 19.

The signal which is transmitted by the monitoring device 17 and corresponds to the height of the non-equalized tobacco stream 7 is transmitted, as indicated in FIG. 1, to the input a of a function generator 46 in which the value pairs for different distances of the cutting plane E of the equalizer 8 from the conveyor belt 3 and thus for the height Ht of the equalized non-densified tobacco filler 7a in dependence on the height Hs of the non-equalized tobacco stream 7 are stored. It is assumed that the stream building zone 6 receives tobacco shreds at least approximately at a constant rate so that the quantity of tobacco per unit of length of the non-equalized tobacco stream 7 is at least approximately constant.

In this case, the monitoring device 18 need not be provided. To the function generator 46, there can be supplied, for further influencing, besides the measuring signals corresponding to the height Hs, signals via corresponding inputs b which correspond to different, but always constant, supplied tobacco amounts m1, m2, m3 per unit length of the stream 7 wherein m1 corresponds to large and m3 to small amounts. The relationship which is established by the function generator 46, between input signals Hs, amount-dependent signals m1, m2, m3 and height values Ht of the equalized non-densified tobacco filler 7a for the formation of the cigarette rod 7b and thus for the manufacture of cigarettes of constant hardness, is shown in the diagram of FIG. 4.

The output signal Ht, which is formed by the function generator 46 in an analog manner or calculated in accordance with a program corresponding to the predetermined function in a digital manner and is transmitted by the output c, serves for controlling the removal of tobacco fibers in the sense of constant "filling force" or hardness of the equalized wrapped densified tobacco filler (cigarette rod 7b) and thus of the cigarettes 15. The above-mentioned expressions denote to one familiar with the manufacture of cigarettes the resistance which a cigarette offers to deformation in the elastic region, for instance, to deformation by a force applied by a constant weight or by the examining fingers of the smoker. This resistance is dependent on various influencing values such as the elasticity of the fibers, the amount and/or the type of tobacco, etc. The smoker judges the quality of the cigarette predominantly in accordance with such hardness inasmuch as he cannot examine the constancy of the quantity of tobacco in a cigarette according to which the cigarettes have heretofore been controlled. Nevertheless, the function generator 46 can also be so constructed that its output signal serves for controlling the removal of the tobacco fibers to ensure that the amount of tobacco in the finished cigarettes is constant. Then, the function correlation between Hs and Ht conforms to this changed control value "tobacco amount" (instead of density).

The signal at the output c of the function generator 46 is transmitted as a desired value to a regulating circuit for the height Ht of the equalized non-densified filler 7a. Advantageously, a position-regulating circuit for the cutting plane E of the equalizer 8 is suited for this purpose, inasmuch as it simultaneously determines the height of the equalized non-densified tobacco filler 7a. To this end, the output signal of the function generator 46 is transmitted as a desired value to the input a of a signal comparing stage 47 of the position-regulating circuit. An input b of the comparing stage 47 receives a signal which corresponds to the height Ht of the equalized non-densified strand 7a. This signal can be transmitted by an optoelectronic monitoring device 17' which has been illustrated only in a diagrammatic manner and which can be constructed in the same way as that which is illustrated in FIG. 2. However, it is more advantageous to form the signal in dependence on the position of the cutting plane E of the equalizer 8, inasmuch as the latter is simultaneously a measure for the height of the equalized non-densified tobacco filler 7a. To this end, there is provided a height-measuring arrangement 48 on the equalizer 8, the output signal of which is applied to the input b of the comparing stage 47. The measuring arrangement 48 can be a well known, e.g., inductively operating, displacement measuring generator in which a piece of iron influences the inductance of a coil in accordance with the position of the former.

A possible difference between the two signals which are supplied to the comparing stage 47 is transmitted as a regulating deviation to the control arrangement 11, which controls the drive (positioning motor) 9 of the equalizer 8 in such a manner that the position of the cutting plane E is a function of the control signal Ht (desired value of the position-regulating circuit) transmitted by the function generator 46.

The described control thus operates as a so-called "advance control" for maintaining the hardness of the finished cigarettes at a constant value.

A further possibility of the advance control of the cutting plane E of the equalizer 8 to ensure constant hardness (or constant weight) of the finished cigarettes is in dependence on the measuring signals transmitted by the monitoring device 18 (FIG. 3). However, this presupposes that the height Hs of the supplied non-equalized tobacco stream 7 is at least approximately constant. Then, the monitoring device 17 for the height of the non-equalized tobacco stream 7 can be omitted.

As illustrated in FIG. 5, the measuring signal which is transmitted by the monitoring device 18 and corresponds to the flow resistance Rg of the tobacco stream 7 between its exposed surface and the suction chamber 19 is applied to the input a of a function generator 52 in which there are stored value pairs for different distances of the cutting plane E of the equalizer 8 from the conveyor belt 3, and thus of the height Ht of the equalized non-densified tobacco filler 7a, in dependence on the flow resistance Rg of the non-equalized tobacco stream 7. To the function generator 52, there can be supplied for further influencing, besides the measuring signals corresponding to the flow resistance Rg, signals via corresponding inlets b which correspond to different, but always constant, heights Hs1, Hs2, Hs3 of the tobacco stream 7. Hs3 denotes small and Hs1 to large heights.

The relationship which is established by the function generator 52 between the input signals Rg, the height-dependent signals Hs1, Hs2, Hs3, and the height values Ht of the equalized non-densified tobacco filler 7a for the formation of a cigarette rod 7b and thus for the manufacture of cigarettes of constant hardness is illustrated in the diagram of FIG. 6.

The output signal Ht which is formed by the function generator 52 in an analog manner or which is digitally calculated in accordance with a program corresponding to the predetermined function, and which appears at the output c of the function generator 52 serves to control the removal of tobacco fibers to achieve constant hardness of the cigarette rod 7*b* and thus of the cigarettes 15. To this end, the output signal is again transmitted as a desired value signal to an input a of the signal comparing stage 47 of a position-regulating circuit for the distance of the cutting plane E from the conveyor belt 3. An actual value signal is supplied as a measure for the height Ht of the tobacco stream 7 equalized by the equalizer 8 to the input b of the comparing stage 47. This actual value signal is again advantageously generated in dependence on the position of the cutting plane E as determined by the height measuring arrangement 48. A possible difference between the two signals which are supplied to the comparing member 47 controls, via control arrangement 11 and the positioning motor 9, the cutting plane E to maintain the height of the filler 7*a* at the value Ht which is predetermined by the desired value signal.

Even in this kind of advance control, the function correlation between Rg and Ht can be so selected that the amount of tobacco in the cigarette rod 7*b* (per unit length) and thus in the cigarettes 15 is maintained constant.

If the height of the supplied tobacco stream 7 is not constant, a further equalizer 8′ with clamping discs 8*a*′ and a brush 8*b*′ (FIG. 1) can be provided for preliminary equalization upstream of the monitoring device 18 so that the tobacco stream 7 arrives at the locus of the monitoring device 18 already with a constant height Hs.

When the conditions of constant height Hs and constant amount of tobacco, which are needed for the various controls of the equalizer 8 to ensure constant hardness of the cigarettes (or constant tobacco amounts in the cigarettes) are not satisfied, and, instead, pronounced deviations are encountered, the equalizer 8 can be controlled by the signal supplied by the monitoring device 17 as well as in dependence on the measuring signal supplied by the monitoring device 18 (see FIG. 7).

The signal which is transmitted by the monitoring device 18 and which depends on the flow resistance is used, in this embodiment of the invention, to first establish the density Du of the non-equalized tobacco stream 7. To this end, the electrical measuring signal corresponding to the flow resistance Rg and transmitted by the monitoring device 18, and the electrical measuring signals Hs1, Hs2, Hs3 corresponding to the height of the stream and transmitted by the monitoring device 17, are applied to the input a or to the input b of a function generator 53 which, as shown in the diagram of FIG. 8, part I, transmits at its output a signal which corresponds to the density Du of the non-equalized stream 7.

In part I of the diagram of FIG. 8, the curves denote the functional relationship between the flow resistance Rg and the density Du for different values of the heights Hs1 (small), Hs2 (intermediate), Hs3 (large) of the non-equalized stream 7.

The signal at the output c of the function generator 53 corresponds to the density Du and is transmitted to the input a of a further function generator 54 to the input b of which there can be supplied certain values for the desired hardness of the cigarette rod (or the amount of tobacco per unit length of the rod).

Part II of the diagram of FIG. 8 depicts the functional relationship between the density values Du of the non-equalized tobacco stream 7 and the positions of the cutting plane E of the equalizer 8 in order to obtain certain hardness values G1 (soft), G2 (intermediate), G3 (rigid) and so on, which are to remain constant in the cigarettes (instead of the hardness values, curves with desired different values of tobacco quantity, which are to be held constant, can be predetermined to regulate the quantity).

The operation of the function generators 53, 54 is similar to operation of the function generator 46 of FIG. 1. The outputs c of the function generators 53, 54 transmit analog but preferably digital signals for each value at their inputs a and also in dependence on additional parameters denoted by the signals applied to the inputs b and corresponding to predetermined functional relationships. The output signals then serve for the control of removal of tobacco fibers for the formation of a cigarette rod 7*b* and thus for the production of cigarettes of constant hardness (or amount).

The signal at the output c of the function generator 54 is transmitted as a desired value signal to the input a of the signal comparing stage 47 which is associated with a position-regulating circuit 48 and to the input b of which is applied an actual value signal for the height Ht of the equalized filler 7*a;* this signal is advantageously again transmitted by the height measuring arrangement 48 for the distance of the equalizer 8 (that is, of its cutting plane E) from the conveyor belt 3. A possible difference between the two signals which are supplied to the comparing member then controls, via amplifier 11 and the positioning motor 9, the distance of the equalizer 8 from the conveyor belt 3 to the value Ht which is denoted by the desired value signal.

In the above-described manner, the cutting plane E of the equalizer 8 is controlled in advance in dependence on the height Hs of the non-equalized tobacco stream which is determined in an optoelectronic manner, and additionally on the flow resistance Rg of the fibers in the non-equalized stream 7 transversely to the direction of its advancement so that the hardness of the cigarettes 15 is at least approximately constant, even though the height Hs of the non-equalized tobacco stream 7, as well as the quantity of tobacco therein can vary. As already explained hereinabove, the circuitry can be modified in accordance with other parameters in the function generators 53 and 54 that one can achieve an advance control to ensure that the quantity of tobacco in the cigarettes 15 will remain constant.

Figure 9:
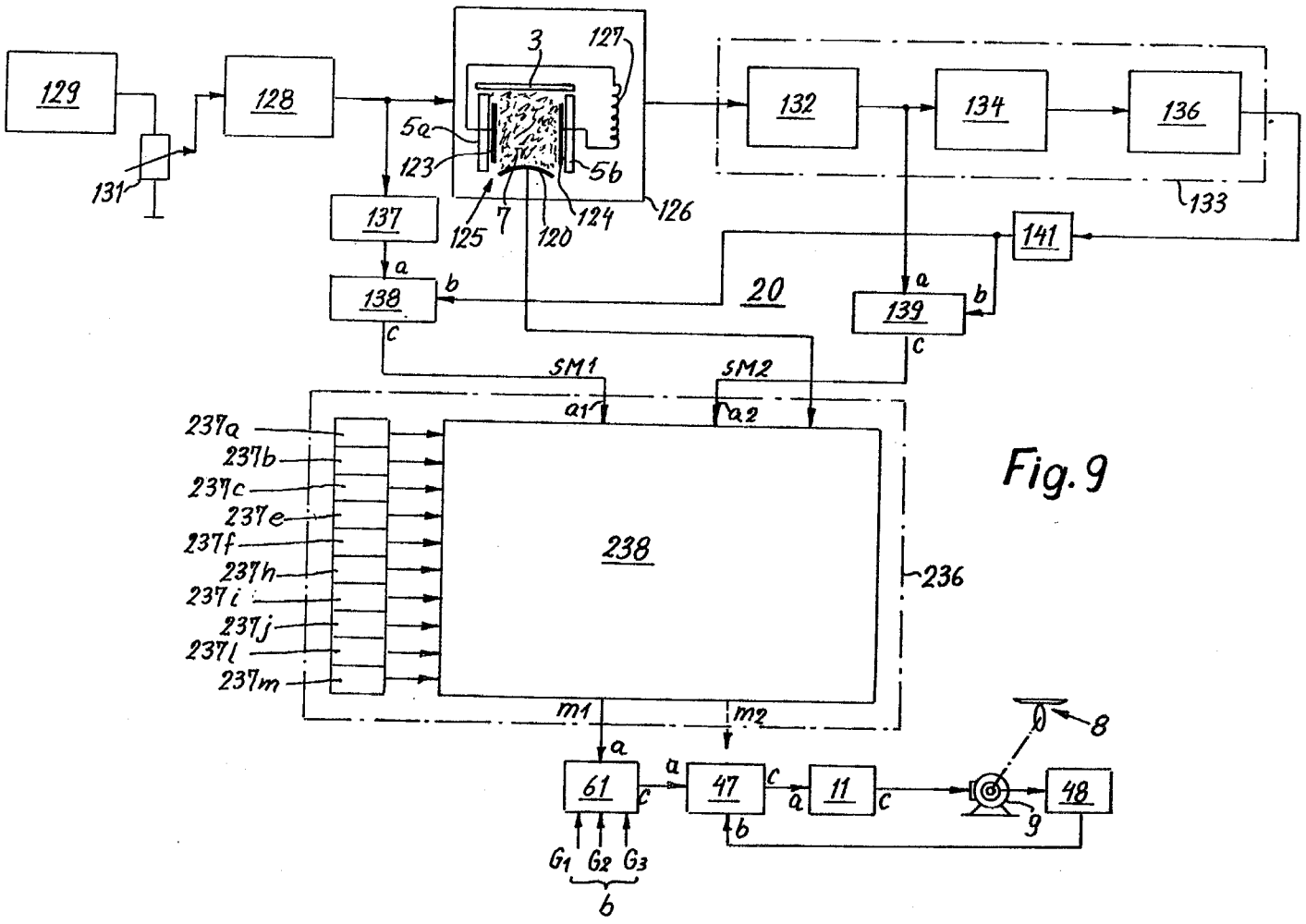
FIG. 9 is a view of a capacitive arrangement for measuring the density of the stream.

A further possibility of measuring of the density the non-equalized tobacco stream is illustrated in FIG. 9. In this embodiment, the density is determined not with resort to values representing the height and the flow resistance of the non-equalized tobacco stream 7 which is advanced by the conveyor belt 3 between stationary walls 5*a* and 5*b*, but rather in a capacitive manner. The measuring location herein is again located upstream of the equalizer 8 (FIG. 1). The capacitive monitoring device replaces the monitoring devices 17 and 18.

FIG. 9 shows the principle of a capacitive monitoring device 20 for the determination of the density M1 of the tobacco stream 7, and of the moisture content M2 of tobacco. The electrodes 123 and 124 of a measuring capacitor 125 are located at the opposite sides of the tobacco stream 7 so that, when supplied with voltage, they generate a homogeneous electrical field therebetween. The measuring capacitor 125 constitutes the capacitance of a high-frequency oscillating circuit 126 which further includes a coil 127. The ohmic resistance of the oscillating circuit 126 is not shown.

The oscillating circuit 126 incorporates a carrier frequency oscillator 128, which is controllable as to its frequency and which oscillates at a basic frequency of 10 MHz. This frequency is so controllable by a control oscillator 129 of 1 KHz that the frequency of the carrier frequency oscillator 128 is periodically varied (wobbled) between two extreme values about the basic frequency. The magnitude of the frequency variations between the extreme values is so selected that it readily suffices to let the measuring oscillating circuit 26 come in resonance once during each passage of the frequencies of the oscillator 128 between the extreme values. The control of the oscillator 128 takes place by means of the amplitude of the constant frequency of 1 KHz of the control oscillator 129, which is adjustable by means of a potentiometer 131.

Thus, the frequency distance between the extreme values of the frequencies of the oscillator 128 can be adjusted via the amplitude. The basic frequency of 10 MHz of the oscillator 128 and thus of the oscillating circuit 126 is sufficiently high to achieve aceptable signal intensities.

An amplitude measuring arrangement 133, which consists of a demodulation stage 132, a differentiating stage 134, and a comparing stage 136, is connected to the oscillating circuit 126. The demodulation stage 132 forms the envelope curve of the high-frequency voltage of the measuring member 126 and transmits the same to the differentiating stage 134 which generates a zero signal at the occurrence of an extreme value (e.g., maximum) of the demodulated voltage. The comparing stage 136 establishes, when the differentiated voltage (a time derivative) of the voltage increase is at the "zero" value which means that the demodulated voltage of the oscillating circuit 126 which is transmitted by the demodulation stage 132 has a maximum value at such time. The comparing stage 136 then transmits an output signal which is applied to a monostable multivibrator 141.

A discriminating stage 137 which, together with the differentiating stage 134 and the comparing stage 136, forms a resonance frequency measuring arrangement, receives high-frequency voltage from the oscillator 128 which also applies such voltage to an input of oscillating circuit 126. The stage 137 transmits an output signal which is proportionate to the frequency of the input signal to the input a of a storage 138. The signal at the output of the demodulation stage 132 is also applied to the input a of a further storage 139. The admission of measuring signals at the inputs a of the storages 138 and 139 into these storages is controlled by a control signal which is applied to the inputs b of the storages 138 and 139. This control signal is transmitted by the monostable multivibrator 141 which is connected to the comparing stage 136 and generates, after activation via output signal of the comparing stage 136, a control signal of exactly defined pitch and length, so that it acts as a pulse forming stage. The comparing stage 136 transmits a control signal at the instant at which the measuring oscillating circuit is at resonance, which is determined by means of the differentiating stage 134 from the maximum conditions. Therefore, the signals at the inputs b of the storages 138 and 139 at the time of transfer correspond to the frequency and the damping of the oscillating circuit 126 when the latter is in resonance.

As mentioned above, the amplitude of the current of the control oscillator 129 which oscillates at 1 KHz is controllable by means of the potentiometer 131. The effective capacitance of a capacitance diode (not illustrated) in the oscillator 128 and thus the deviation (in the example 1 MHz) of the extreme values, which the frequency of the voltage of the oscillator 128 can assume, from the basic value of 10 MHz can be controlled via different amplitudes. At the basic frequency of 10 MHz in the oscillator 128, which has been given as an example, the periodical frequency variations of the oscillator 128 can amount to, e.g., $\pm 1$ MHz, so that the frequency of the high-frequency voltage which is applied to the oscillating circuit 126 is periodically varied (wobbled) (with the frequency of 1 KHz) between the extreme values 9 and 11 MHz. The oscillating circuit 126 includes a coupling coil (not illustrated) which simultaneously constitutes the oscillating circuit inductance, and the measuring capacitor 125 with the tobacco stream 7 situated between the electrodes 123 and 124 which forms the capacitance of the oscillating circuit 126.

The comparing stage 136 includes a resistance (not illustrated) and an operational amplifier (not illustrated) with a very steep characteristic line. Consequently, the amplifier acts not unlike a switch and achieves its end value in response to the application of very small input signals. The monostable multivibrator 141 which is connected to the stage 136, converts each signal change into a signal of exact duration and intensity.

The discriminating stage 137 has a special switching element which incorporates a circuit with a resistance, capacitors and a throttling coil, e.g., of the type TAA 661 of the firm SGS Deutschland GmbH, Wasserburg (Inn). The output of this switching element, which is available as a structural unit, transmits an electric signal which is exactly proportionate to the frequency of the input signal.

The storages 138 and 139 are of identical design. Each of these storages comprises a rapidly controllable electronic switch, a storage capacitor and an operational amplifier with a very high ohmic input. The switch opens in response to transmission of a signal from the monostable multivibrator 141 to its input during a precisely defined time period, so that a signal which is applied to a different input can be registered by the storage capacitor as a voltage value.

Measuring signals SM1, SM2, which will be discussed presently, are transmitted by the outputs c of the storages 138 and 139.

The measuring signal SM1, which corresponds to the frequency of the oscillating circuit 126 at the moment of resonance (resonance frequency), is determined by the capacitance of the measuring capacitor 125. This capacitance is influenced by the dielectric constant $\epsilon$ of the tobacco fibers in the tobacco stream 7 and the amount of moisture contained in the tobacco stream 7. Thus, the resonance frequency of the oscillating circuit 126 varies in dependence of the dielectric constant.

The measuring signal SM2 which corresponds to the amplitude of the voltage (1 KHz) of the oscillating circuit 126 at the moment of resonance is a measure of damping of the oscillating circuit 126, which is determined via the ohmic losses in the dielectric of the measuring capacitor 125. The ohmic losses (tan $\delta$) are also influenced by the density of tobacco in the tobacco stream 7 and by the moisture content of the tobacco.

The dielectric constant $\epsilon$ and the ohmic losses (indicated, among others, also as tan $\delta$), are indicators of different physical properties of the stream 7a which are differently influenced by the two substances of the combination located in the electric field of the measuring capacitor 125.

This different influencing is to be understood in such a manner that the amounts of the two substances differently influence the ratio of the characteristic values $\epsilon$ and tan $\delta$ of the highfrequency oscillating circuit 126.

Inasmuch as, consequently, the dielectric constant $\epsilon$ as well as the loss angle tan $\delta$ of the dielectric of the measuring capacitor 125 are influenced, to different extents, by the density of the tobacco and the amount of moisture contained therein, the measuring signals SM1 or SM2 which are correspondingly dependent on the capacitance or on the tan $\delta$ (damping) of the measuring oscillating circuit, can be utilized in an evaluating arrangement 236 for automatic determination of the mass M1 of the tobacco (and the mass M2 of the moisture).

The density determination in the evaluating arrangement 236 is based on the following considerations:

A functional relationship exists between the two values M1, M2 of the different substances "tobacco" and "moisture" and the measuring values (measuring signals) SM1 and SM2, which can be expressed in the general form of polynomial equations:

$$M_1 = a + b \cdot SM_1 + c \cdot SM_1^2 + d \cdot SM_1^3 + \ldots + n_{11} \cdot SM_1^n + e \cdot SM_2 + f \cdot SM_2^2 + g \cdot SM_2^3 + \ldots + n_{12} \cdot SM_2^n$$

$$M_2 = h + i \cdot SM_1 + j \cdot SM_1^2 + k \cdot SM_1^3 + \ldots + n_{21} \cdot SM_1^n + l \cdot SM_2 + m \cdot SM_2^2 + o \cdot SM_2^3 + \ldots + n_{22} \cdot SM_2^n.$$

To obtain a solution of these equations, it is first necessary to experimentally establish the relationship of M1, M2, and SM1, SM2. This can be accomplished in such a manner that the amount of the moisture in tobacco (M2) is kept constant.

Then, the values of the associated measuring signals SM1 and SM2 are respectively measured at different M1 values (that is, tobacco density values). In this manner, there is obtained a first family of curves. In a similar manner, the density of the tobacco, that is M1, is subsequently kept constant, and M2, that is the amount of the moisture, is varied, while again the values of the associated measuring signals SM1 and SM2 are measured. In this manner, there is obtained a second family of curves.

Now, there can be formed a matrix from the above-mentioned polynomials with powers of SM1 and SM2 which correspond to the number of the measuring value pairs of SM1 and SM2. From this system of equations, there can be determined—possibly by means of a conventional desk calculator—the constants a . . . $n_{22}$ which are associated with the respective powers of the polynomials. The model 30 of the series 9800 of the firm Hewlett-Packard can be utilized as a desk calculator of this type. When the calculator is caused to carry out computations for a variable number of value pairs and thus of powers, one can see very quickly which powers are needed for the achievement of a predetermined desired measuring accuracy. As an example, it can be assumed that already the third power brings about negligible values, so that it is only necessary to sense the coefficients a to c, e, f, h to j, l and m as constant determination values for the density M1 (and the amount M2) of a tobacco stream to be measured.

The above-mentioned coefficients are stored in coefficient storages 237*a* . . . 237*m* of the evaluating arrangement 236 and they are transmittable, within the calculating cycles, to a calculator 238, to the inputs a1 and a2 of which the measuring signals SM1 and SM2 are transmittable. The calculator cyclically calculates, in accordance with a certain control program, based on the signals which are transmitted to it and which correspond to the stored coefficients a . . . m, as well as based on the measuring signals SM1 and SM2, the tobacco density M1 (and the amount M2) of the tobacco stream 7 which passes through the measuring capacitor 125. Calculating programs for automatic calculation of polynomials based on constant coefficients and known base numbers for powers are widely known and can be realized, in the terms of circuitry, e.g., by the above-mentioned desk calculator of the firm Hewlett-Packard. Then, signals can be derived from the outputs m1 and m2 of the calculator 238, which correspond to the density M1 of the tobacco (or to the amount M2 of the moisture contained therein).

The idea on which the above-described circuitry is based, is not limited to a reduction of the relations between density and measuring signals to polynomials of the n-th order. It is also possible, commencing from the families of curves for a density which is held constant and a varied amount, to select functions with similar characteristics and to transform them by iterative operations in a satisfactory mathematical expression, to store the corresponding constant determination values and to use the same for the automatic determination of the densities or amounts based on the measuring signals SM1 and SM2.

A further possibility of arriving at the constant determination values resides in constantly feeding families of curves into a calculator by special feeding devices, for instance, based on scanning. The calculator then subsequently automatically arrives at a determination of the optimally approximated function and the constant determination values of the same.

When tobacco sorts and/or moisture contents are very different, it can be recommended to separately determine the functions (polynominals) and the constant coefficients for individual tobacco sorts. This is simplified by the fact that the individual tobacco mixtures may very strongly differ from one another, but that they are very homogeneous and constant within themselves.

The signal SM1 which corresponds to the density of the non-equalized tobacco stream 7 is transmitted to the input a of a function generator 61, to the input b of which there are transmitted the values for the desired hardness G1 (soft), G2 (intermediate), G3 (rigid). In the manner which has been explained with reference to FIG. 7, the signal at the output c of the function generator 61 is transmitted as a desired value signal Ht to the input a of the comparing stage 47 which is incorporated in the position-regulating circuit 48 and the input b of which is supplied with a measuring signal which is transmitted by the measuring arrangement 48, depends on the height Ht of the equalized tobacco filler 7*a* and corresponds to the actual value. The actual value signal Ht is again transmitted by the measuring arrangement 48 for measuring the distance between the cutting plane E and the conveyor belt 3.

The signal which appears at the output c of the stage 47 when a possible difference, which corresponds to the regulating deviation, exists between the two signals that are applied to the comparing stage, is transmitted to the control arrangement 11 for the positioning motor 9 for the adjustment of the position of the removal location E of the equalizer 8 until coincidence of the desired and actual values is obtained.

The formation of a cigarette rod 7*b* and thus the production of cigarettes of constant hardness (or amount) is possible even in this manner.

The above-described so-called "advance controls" of the cutting plane E of the equalizer 8 in dependence on measuring signals which have been formed before the tobacco stream 7 has reached the trimming station have the advantage that the tobacco filler 7*a* can still be influenced. A disadvantage is that a supervision of the intervention is missing, which would be achievable only by means of a true regulation which, however, has the disadvantage of a system-caused delay.

A regulation of the filler formation to a constant hardness of the cigarettes is illustrated in FIG. 10.

The measuring signal which is transmitted by the measuring arrangement 22 and which corresponds to the density or amount Dg of the tobacco in the equalized and densified cigarette rod 7*b*, is transmitted to the input a of a function generator 66 in which there are stored value pairs for different distances of the cutting plane E of the equalizer 8 from the conveyor belt 3, and thus for the height Ht of the equalized non-densified tobacco filler 7*a*, in dependence on the density values of the equalized densified tobacco filler (cigarette rod 7*b*). In addition thereto, signals corresponding to different hardness G1, G2, G3 of the cigarettes, to which the cigarette production is to be controlled, can be transmitted to the input b of the function generator 66.

The diagram of the FIG. 8, part III depicts the relationship, which is established by the function generator 66, between the input signals Dg that are transmitted by the measuring arrangement 22, the hardness-dependent signals G1 (soft), G2 (intermediate), G3 (hard), and the height Ht of the equalized non-densified tobacco filler 7*a*.

The signal at the output c of the function generator 66 in an analog manner or calculated according to a program in correspondence with the predetermined function in a digital manner, which corresponds to Ht is used within the regulating circuit for the control of the equalizing operation in the sense of maintaining the hardness or the filling force of the equalized densified tobacco rod 7*b* and thus of the finished cigarettes 15 at a constant value.

The signal at the output c of the function generator 66 is transmitted, after its comparison with a desired value (reference) signal issued by a desired value signal generator 66 in a comparing stage 66*b*, as a desired value to a regulating circuit for the height Ht of the equalized non-densified filler 7*a*. Advantageously, a position-regulating circuit for the distance of the cutting plane E of the equalizer 8 from the conveyor belt 3 is suited for this purpose, inasmuch as the same simultaneously determines the height Ht of the equalized non-densified tobacco filler 7*a*. The signal at the output of the function generator 66 is transmitted as a desired value signal to the input a of a comparing stage 67 of the position-regulating circuit. The input b of the comparing stage 67 is acted upon by a signal which corresponds to the height Ht of the equalized non-densified filler 7*a*. This signal can be transmitted by the diagrammatically illustrated optoelectronic monitoring device 17' which is constructed in the same manner as the one which is illustrated in FIG. 2. However, it is more advantageous to form the signal in dependence on the position of the cutting plane E of the equalizer 8, inasmuch as the same simultaneously constitutes a measure for the height Ht of the equalized non-densified tobacco filler 7*a*. To this end, there is provided a height-measuring arrangement 48 the output signal of which is transmitted to the output b of the comparing stage 67. As already mentioned, the measuring arrangement 48 can be an inductive measured-value signal generator in which a piece of iron influences the inductance of a coil in dependence on the position of the former.

A possible difference between the two signals, which are transmitted to the comparing stage 67 is transmitted as a position regulating deviation to the control arrangement 11 which so controls the positioning motor 9 of the equalizer 8 that the cutting plane E eventually coincides with its desired position indicated by the control signal which is transmitted by the function generator and which corresponds to Ht (desired value of the position-regulating circuit).

It is possible, by this true regulation, to compensate for long-lasting inaccuracies of the "advance controls" which latter are controlled by the signals supplied by the monitoring devices 17, 18 or 20, and to assure, over a long time span, the production of cigarettes of constant hardness.

A switching arrangement 68 renders it possible to supply the measurement signal corresponding to the density of the cigarette rod 7*b* directly, i.e., via the control conductor 69 which is shown by broken lines, from the monitoring device 22 to the comparing stage 67, when the advance controls which are effected by the devices 17, 18 and 20 are to be carried out in the sense of amount regulation. Such controls to achieve a constant tobacco amount (instead of hardness) in the cigarettes are possible in accordance with the previous description. As a result of the possibility of switching, the controls or regulations can thus be selectively operated to achieve constant hardness of the cigarettes or constant tobacco amounts in the cigarettes, in accordance with the desire of the cigarette manufacturer.

It lies within the framework of the invention to correct the functions given in the individual function generators in the sense of taking into consideration varying tobacco temperatures, which can be accomplished by program-controlled function generators in a relatively simple manner. This can be advantageous inasmuch as pronounced temperature variations can render the signals of the monitoring devices 17, 18 and 29 in controls or regulations to constant hardness inaccurate or misrepresentative.

In addition thereto, it is possible to provide a limiting value generator 71 which transmits to the control arrangement 11 upper (line 72) and lower (line 73) limiting value signals for the amount which must be exceeded or fallen below even when the hardness is regulated. When one of these limits is reached, the filler formation is continued with the corresponding limiting value.

Furthermore, it lies within the framework of the invention to control or regulate the manufacture of other rod-shaped articles, which are manufactured in tobacco-handling industry from a material which is suitable for smoking, e.g., cigars or cigarillos, in the manner according to the invention.

Finally, it lies in the framework of the invention to control or regulate the manufacture of other rod-shaped articles which are produced in the tobacco-handling industry, for example, of filter material, in accordance with the invention, provided that a part of the material is to be removed during the manufacture with the purpose of equalizing the stream.

FIG. 10*a* illustrates a modification of the arrangement of FIG. 10 wherein density-dependent signals from the monitoring device 22, on the one hand, and stream height-dependent signals from the measuring arrangement 48, on the other hand, are supplied to the function generator. The function generator 66 then generates and transmits analog or digital signals which correspond to the rigidity values of the wrapped filler strand, in accordance with a program which corresponds to a determined functional correlation of the two input signals. Those output signals of the function generator 66 which correspond to the hardness are supplied not only to the comparing stage 66*b* but also to a deviation calculator 66*c* for determination of the deviation of the hardness-dependent signal furnished by the function generator 66. The signal at the output of the deviation calculator 66*c* is transmitted to a function generator 66*d* which influences the desired value generator 66*a* in such a way that the intensity of the hardness-dependent desired value signal transmitted by the latter increases with increasing deviation, and diminishes with diminishing deviation (target shifting). In this manner, it can be achieved that always approximately the same number of the articles (cigarettes) statistically lies outside of a predetermined limit which can, for instance, be designated as "limit of unacceptability".

In order to avoid the possibility that certain amount of weight limits would be exceeded, there can be provided a limiting member 66*e* which prevents the occurrence of changes of the desired value beyond certain limits.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

I claim:

1. A method of producing an elongated filler which consists of fibers, especially tobacco shreds, comprising the steps of continuously forming from the fibers an elongated stream which contains a surplus of fibers and advancing the stream lengthwise; equalizing the advancing stream by removing the surplus of fibers therefrom; generating a first signal which denotes the height of the equalized stream: densifying and wrapping the equalized stream to convert the stream into the filler; generating a second signal in dependence on the mass flow of the equalized stream; correcting the second signal in accordance with a function which is indicative of a desired hardness of the filler and represents a predetermined relationship between said first and second signals; generating a control signal in dependence on the corrected second signal; and regulating said equalizing step in dependence on said control signal so as to maintain the hardness of the filler at a constant value.

2. The method as defined in claim 1, wherein said regulating step includes comparing said first signal with said control signal and changing the location of removal of said surplus relative to the stream when said first signal differs from said control signal.

3. The method as defined in claim 2, wherein said step of generating said first signal includes monitoring the position of the location of removal of said surplus relative to the stream.

4. The method as defined in claim 2, wherein said step of generating said first signal includes monitoring the height of the equalized stream prior to said densifying step in a contactless manner.

5. The method as defined in claim 1, further comprising the step of selectively dispensing with said correcting step when the density of the filler is to remain constant.

6. The method as defined in claim 1, further comprising the steps of generating a further signal denoting the height of the stream prior to said equalizing step and influencing said equalizing step in dependence on said further signal.

7. The method as defined in claim 6, wherein said step of generating said further signal includes monitoring the height of the stream prior to said equalizing step in a contactless manner.

8. The method as defined in claim 6, wherein said influencing step includes correcting said second signal in accordance with a function which denotes a desired value of the hardness of the filler and represents a predetermined relationship between the height of the equalized stream prior to said densifying step and said further signal.

9. The method as defined in claim 1, further comprising the steps of generating an additional signal denoting the flow resistance of the stream prior to said equalizing step and influencing said equalizing step in dependence on said additional signal.

10. The method as defined in claim 9, wherein said step of generating said additional signal includes passing an air stream across the stream transversely of the direction of advancement of the stream.

11. The method as defined in claim 9, wherein said influencing step includes correcting the second signal in accordance with a function which denotes a desired hardness of the filler and represents a predetermined relationship between the height of the equalized stream prior to said densifying step and the additional signal.

12. The method as defined in claim 1, further comprising the steps of generating a further signal denoting the height of the stream prior to said equalizing step, generating an additional signal denoting the flow resistance of the stream prior to said equalizing step, generating a still further signal denoting the density of the stream prior to said equalizing step and correcting the second signal in accordance with a function which represents a predetermined relationship between the further, additional and still further signals.

13. The method as defined in claim 1, further comprising the steps of generating an additional signal denoting the density of the stream prior to said equalizing step, correcting the additional signal in accordance with a function which denotes a desired hardness of the filler and represents a predetermined relationship between the height of the equalized stream prior to said densifying step and said additional signal, and influencing said regulating step as a function of said corrected additional signal.

14. The method as defined in claim 1, further comprising the steps of generating an additional signal denoting the density of the stream prior to the equalizing step, including passing the stream as a dielectric through the capacitor of a high-frequency oscillating circuit, separately monitoring the capacitance and damping of the oscillating circuit, and forming the additional signal in dependence on the monitored values of capacitance and damping, correcting the additional signal in accordance with a function which denotes a desired hardness of the filler and represents a predetermined relationship between the height of the equalized stream prior to said densifying step and the additional signal, and influencing said regulating step as a function of the corrected additional signal.

15. The method as defined in claim 14, wherein said step of generating said additional signal includes storing constant determination values denoting the capacitance and damping, and automatically determining the density of the stream based on the monitored capacitance and damping and on the stored determination values.

16. The method as defined in claim 15, wherein said storing step includes storing the determination values as coefficients and functions of polynomials of the n-th order.

17. The method as defined in claim 1, further comprising the steps of generating an additional signal denoting a parameter of the stream prior to said equalizing step and influencing said regulating step, said influencing step including comparing the first signal with said additional signal, and changing the location of removal of said surplus when said first signal deviates from said additional signal.

18. An apparatus for producing an elongated filler from fibers, especially from tobacco shreds, comprising a conveyor; means for continuously feeding fibers onto said conveyor so as to build a continuous stream which moves with the conveyor lengthwise and contains a surplus of fibers; means for equalizing the advancing stream including means for removing the surplus of fibers; means for generating first signals denoting the height of the equalized stream; means for densifying and wrapping the equalized stream to convert the stream into the filler; means for measuring the mass flow of the equalized stream, including means for generating second signals denoting the mass of the equalized stream; means for correcting the second signals including a function generator connected to said measuring means and arranged to transmit third signals in correspondence with a function which represents, for a desired hardness of the filler, a predetermined relationship between said first and second signals; and means for controlling the distance between said equalizing means and said conveyor in dependence on said third signals to thereby determine the height of the equalized stream upstream of said densifying means.

19. The apparatus as defined in claim 18, wherein said controlling means includes means for moving said equalizing means in response to said third signals.

20. The apparatus as defined in claim 19, wherein said means for generating said first signals includes means for monitoring the height of the equalized stream, said monitoring means constituting an actuating value generator for said moving means.

21. The apparatus as defined in claim 20, wherein said monitoring means includes a contactless monitoring device.

22. The apparatus as defined in claim 20, wherein said height monitoring means includes means for monitoring the position of said equalizing means relative to said conveyor.

23. The apparatus as defined in claim 18, further comprising means for monitoring the height of the stream adhead of said equalizing means for generating an output signal denoting the height of the non-equalized stream, and means for transmitting the output signal from said monitoring means to said controlling means.

24. The apparatus as defined in claim 23, wherein said transmitting means includes a further function generator connected to said monitoring means and arranged to transmit output signals in correspondence with a function which represents, for the desired hardness of the wrapped filler, a predetermined relationship between the height of the equalized stream upstream of said densifying means and the output signal of said monitoring means.

25. The apparatus as defined in claim 18, wherein said correcting means further includes means for determining variations of said third signals, an additional signal transmitting function generator connected to said determining means, and a desired value signal generator connected to said additional function generator, the latter being operative to control said desired value generator so that the intensity of the desired value signal increases with increasing variation and diminishes with diminishing variation of the signal which is transmitted by said additional function generator.

26. The apparatus as defined in claim 18, further comprising means for generating additional signals denoting the flow resistance of the stream between an exposed surface thereof and said conveyor ahead of said equalizing means and means for transmitting said additional signals to said controlling means.

27. The apparatus as defined in claim 26, wherein said means for generating said additional signals includes a suction chamber.

28. The apparatus as defined in claim 26, wherein said transmitting means includes a further function generator connected to said means for generating said additional signals and arranged to generate an output signal in correspondence with a function which represents, for the desired hardness of the filler, a predetermined relationship between said first and said additional signals.

29. The apparatus as defined in claim 18, further comprising means for generating additional signals denoting the height of the stream ahead of said equalizing means, means for generating further signals denoting the flow resistance of the stream ahead of said equalizing means, and means for transmitting said additional and said further signals to said controlling means, including an additional function generator connected to said means for generating said additional signals and arranged to transmit an output signal in correspondence with a function which represents, for the desired hardness of the filler, a predetermined relationship between the height of the equalized stream ahead of said densifying means and said additional signals, and a further function generator connected to said additional function generator and arranged to transmit an output signal in correspondence with a function which represents, for the desired hardness of the filler, a predetermined relationship between the height of the equalized stream ahead of said densifying means and the output signal of said additional function generator, said last mentioned output signal being a function of said additional and further signals.

30. The apparatus as defined in claim 18, further comprising means for generating additional signals denoting the density of the stream ahead of said equalizing means, including a high-frequency oscillating circuit having a measuring capacitor with plates disposed opposite each other and at the opposite sides of the stream so that the fibers of the stream act as a dielectric, a first arrangement for generating signals denoting the capacitance of said measuring capacitor, a second arrangement for generating signals denoting the damping of said high-frequency oscillating circuit, and means for evaluating the mass of the fibers in the stream as a function of the signals generated by said first and second arrangements based on stored constant determination values which are associated with the function values for the capacitance and damping.

31. The apparatus as defined in claim 30, wherein said first arrangement includes resonance frequency measuring means for an electrical parameter of said high-frequency oscillating circuit.

32. The apparatus as defined in claim 31, wherein said parameter is the high-frequency voltage.

33. The apparatus as defined in claim 30, wherein said second arrangement includes amplitude measuring means for an electrical parameter of the high-frequency oscillating circuit.

34. The apparatus as defined in claim 33, wherein said parameter is the high-frequency voltage.

35. The apparatus as defined in claim 30, wherein said evaluating means includes means for storing the constant determination values.

36. The apparatus as defined in claim 35, wherein said storing means is arranged to store said constant determination values in the form of coefficients and functions of polynomials of the n-th order.

37. The apparatus as defined in claim 30, further comprising a third arrangement for generating signals denoting the temperature of fibers in the stream and means for transmitting signals from said third arrangement to said evaluating means.

38. The apparatus as defined in claim 18, further comprising means for monitoring a parameter of the stream ahead of said equalizing means, including an additional function generator.

39. The apparatus as defined in claim 18, wherein said controlling means includes means for moving said equalizing means and means for monitoring a parameter of the stream ahead of said equalizing means including an additional function generator constituting a desired value generator for said moving means.

40. The apparatus as defined in claim 39, wherein said means for generating said first signals constitutes an actual value generator for said moving means.

41. The apparatus as defined in claim 39, wherein said means for generating said first signals includes a contactless height measuring arrangement.

42. The apparatus as defined in claim 39, wherein said means for generating said first signals includes means for monitoring the position of said equalizing means relative to said conveyor.

* * * * *